United States Patent [19]

Spamer

[11] Patent Number: 4,886,171

[45] Date of Patent: Dec. 12, 1989

[54] DISPLAY STAND CONVERTIBLE TO GRAVITY FEED

[75] Inventor: William S. Spamer, Roswell, Ga.

[73] Assignee: The Mead Corporation, Dayton, Ohio

[21] Appl. No.: 325,905

[22] Filed: Mar. 20, 1989

[51] Int. Cl.[4] ..... A47F 1/00; A47F 7/28

[52] U.S. Cl. ..... 211/59.2; 108/111; 211/74

[58] Field of Search ..... 211/59.2, 186, 74; 108/6, 107, 108, 111; 248/242

[56] References Cited

U.S. PATENT DOCUMENTS

| | | | |
|---|---|---|---|
| 1,711,329 | 4/1929 | Short | 211/59.2 X |
| 2,848,119 | 8/1958 | Fitser | 211/186 X |
| 3,279,618 | 10/1966 | Bergstedt | 211/59.2 |
| 4,416,380 | 11/1983 | Flum | 211/59.2 |
| 4,565,725 | 1/1986 | Spamer et al. | 211/59.2 X |
| 4,665,838 | 5/1987 | Minshall | 211/186 X |
| 4,763,796 | 8/1988 | Flum | 211/59.2 |
| 4,785,943 | 11/1988 | Deffner et al. | 211/59.2 |

FOREIGN PATENT DOCUMENTS

| | | | |
|---|---|---|---|
| 43097 | 1/1970 | Finland | 211/59.2 |
| 1118492 | 6/1986 | France | 211/186 |

*Primary Examiner*—Robert W. Gibson, Jr.

*Attorney, Agent, or Firm*—Rodgers & Rodgers

[57] ABSTRACT

A display stand having four corner posts, horizontal front, rear and side support rails disposed in a common plane and interconnected at their ends to the corner posts to form a pattern of quadrilateral configuration having right angle corners together with a complementary shelf of quadrilateral configuration having right angle corners and being removably supported by the front, rear and side support rails may be converted to a gravity feed device wherein each shelf is tilted forwardly and downwardly due to its support at the rear portion thereof by a pair of support brackets mounted on the side support rails respectively and adjacent the rear ends thereof and projecting upwardly therefrom together with an elongated support element arranged to extend between the support brackets and whose ends are disjointably mounted respectively on the support brackets at a level about the associated rear support rail so that the rear edge of the shelf is disposed above the level of the rear support rail when mounted with its rear portion disposed atop the elongated support element and arranged with its front edge in engagement with and supported by the front rail. A removable front rail is arranged to arrest downward and forward movement of the articles and if desired a plurality of tracks may be mounted on the shelf to guide the movement of the articles.

13 Claims, 2 Drawing Sheets

DISPLAY STAND CONVERTIBLE TO GRAVITY FEED

TECHNICAL FIELD

This invention relates to the conversion of a conventional display stand having removable shelves which normally are disposed horizontally and which are tilted by the invention so as to provide a gravity feed arrangement.

BACKGROUND ART

U.S. Pat. No. 4,314,648 issued Feb. 9, 1982 and assigned to the assignee of this invention discloses a gravity feed shelf in which low friction tracks are utilized and which are formed by an extrusion process and which are homogeneous in nature with low friction material impregnated therein.

U.S. Pat. No. 4,470,953 issued Sept. 11, 1984 and assigned to the assignee of this invention discloses and claims a process for forming a low friction plastic tract which is homogeneous and formed from a mixture of high impact polystyrene and organo polysiloxane fluid such as dimethyl, diethyl and phenymethyl siloxane and related copolymers.

U.S. Pat. No. 4,565,725 issued Jan. 21, 1986 and assigned to the assignee of this invention discloses a composite plastic track and method of making by a coextrusion process.

SUMMARY OF THE INVENTION

A conventional display stand having four corner posts, horizontal front, rear and side support rails disposed in a common plane and interconnected at their ends to the common posts to form a pattern of quadrilateral configuration having right angle corners and provided with a removable complementary shelf supported by the rails is modified in such a way as to convert one or more shelves into downwardly and forwardly inclined elements to form a gravity feed arrangement. The disposition of the shelf is arranged in tilted relationship by means of a pair of support brackets mounted on oppositely disposed side support rails respectively and adjacent the rear ends thereof together with an elongated support element whose ends are disjointably mounted respectively on said support brackets to engage and support a shelf so as to tilt the shelf forwardly with the front edge of the shelf supported by the front rail. The support brackets may be removably mounted or may be fixedly mounted on the side support rails near the rear thereof. According to a feature of the invention, a removable front rail includes an upper upstanding part for arresting forward movement of articles disposed on the shelf when tilted and an integral rearwardly extending lower part is arranged for disposition between the front rail and the front edge of the shelf. If desired, a plurality of tracks may be mounted on the shelf in side by side relation to guide the movement of the articles.

BEST MODE OF CARRYING OUT THE INVENTION

Figure 1:
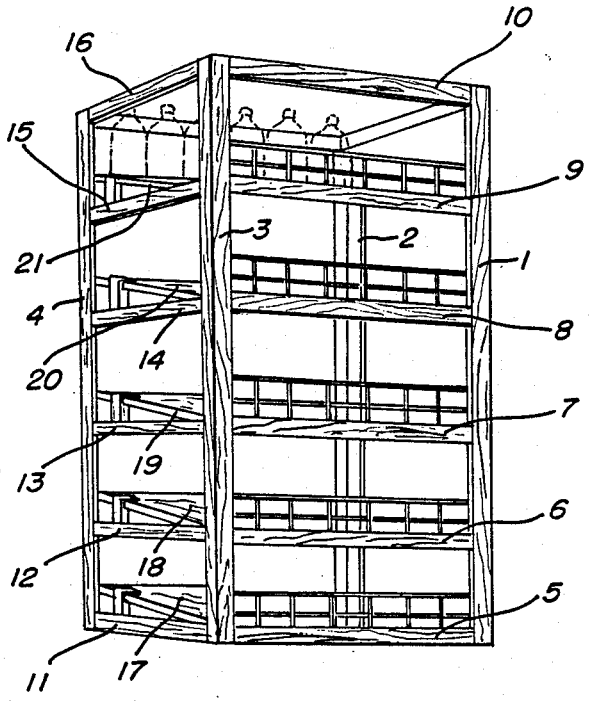
FIG. 1, is a perspective view of a gravity feed display stand formed according to this invention.

With reference to FIG. 1, the numerals 1, 2, 3 and 4 designate corner posts while the numerals 5–10 inclusive designate front rails whose ends are secured to corner posts 1 and 3. Back rails similar to rails 5–10 are interconnected at their ends with corner posts 2 and 4 but such rails are not observable in FIG. 1. Side rails 11–16 inclusive are interconnected at their ends with corner posts 3 and 4. Side rails similar to side rails 11–16 are supported at their ends by corner posts 1 and 2 but such rails are not observable in FIG. 1.

Figure 2:
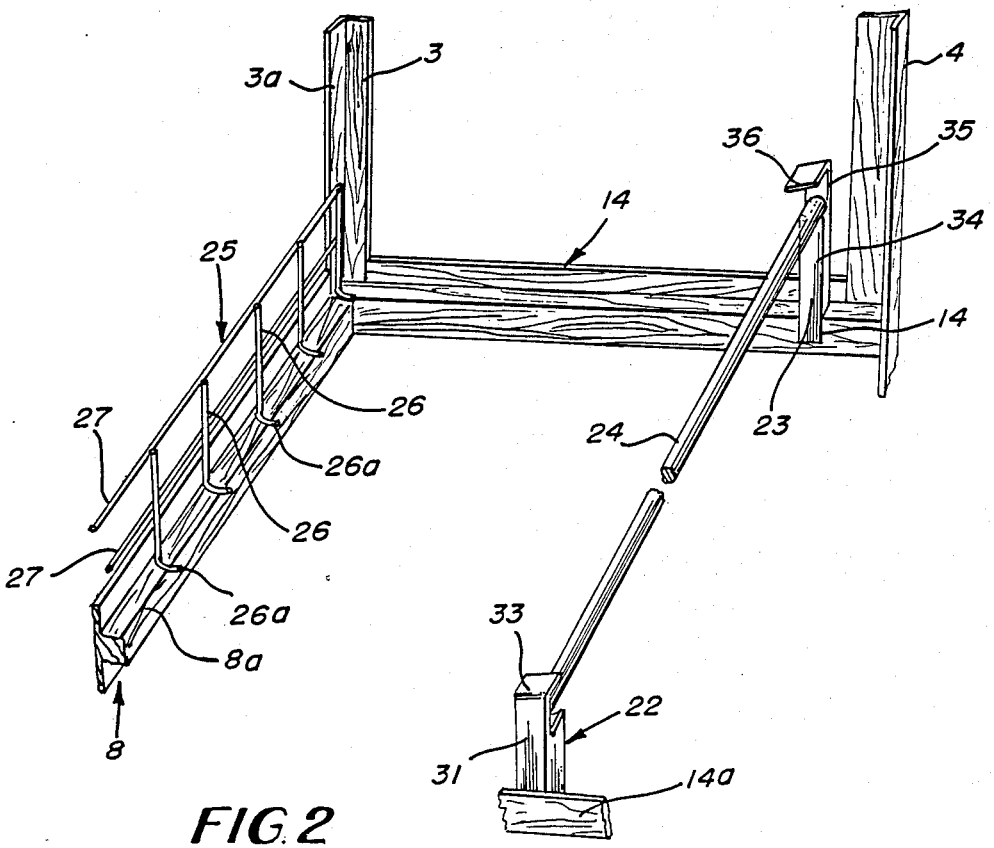
FIG. 2, is an enlarged perspective view of elements formed according to this invention by which a conventional display stand having removable shelves is converted to a gravity feed arrangement.

Each removable shelf such as 17-21 inclusive is tilted downwardly and forwardly according to this invention by means of a pair of support brackets 22 and 23 such as are shown in FIG. 2 in cooperation with an elongated element 24 supported at its ends by support brackets 22 and 23. In FIG. 2 support brackets 23 and 22 are shown mounted respectively within cavities formed atop rails 14 and 14*a*. These support brackets may be fixedly mounted or, if desired, may be movable while attached to the stands or may be disjointably mounted.

Also as is shown in FIG. 2, a removable front bumper rail generally designated by the numeral 25 is provided with an upstanding part comprising vertically disposed elements 26 and horizontally disposed elements 27 welded or otherwise secured to the upstanding elements 26. Rearwardly extending parts of rail 25 are designated by the numerals 26*a*. As is apparent in FIG. 2, the rearwardly extending parts 26*a* of the removable rail 25 are disposed atop a laterally projecting part 8*a* of front rail 8. Also as is apparent in FIG. 2, an end of removable bumper rail 25 engages the laterally extending portion 3*a* of vertical post 3.

Figure 3:
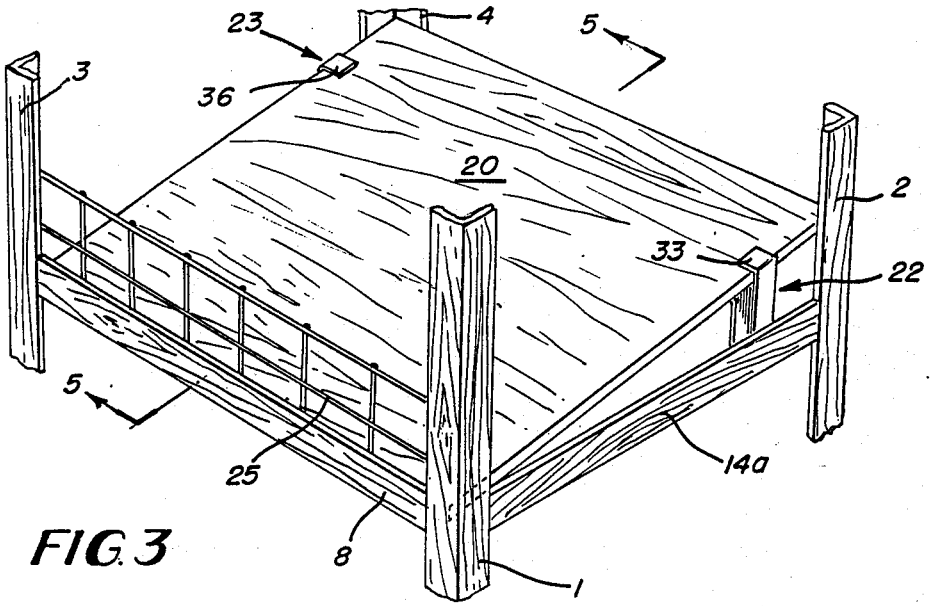
FIG. 3 is a perspective view of a single shelf of a display stand which is shown as a gravity feed arrangement.
Figure 5:
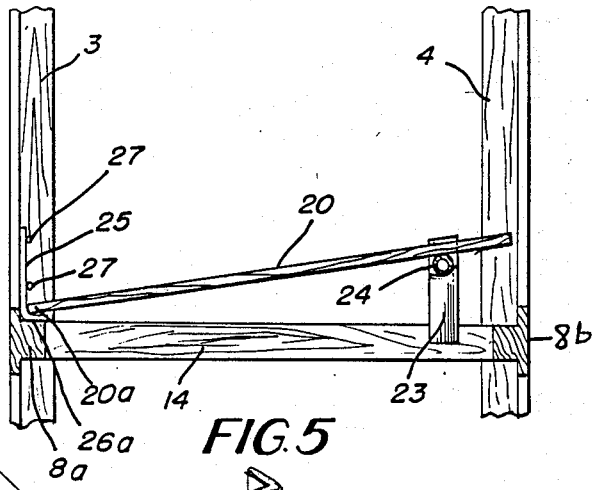
FIG. 5 is a cross sectional view taken along the line designated 5—5 in FIG. 3.

As is shown in FIG. 3, the shelf 20 is disposed in tilted position. As is shown in FIG. 5, the rearwardly extending portion 26*a* of removable bumper rail 25 is captured between the upper surface of part 8*a* of front rail 8 and the lower edge 20*a* of shelf 20. Rear rail 8*b* is shown in cross section in FIG. 5.

Figure 4:
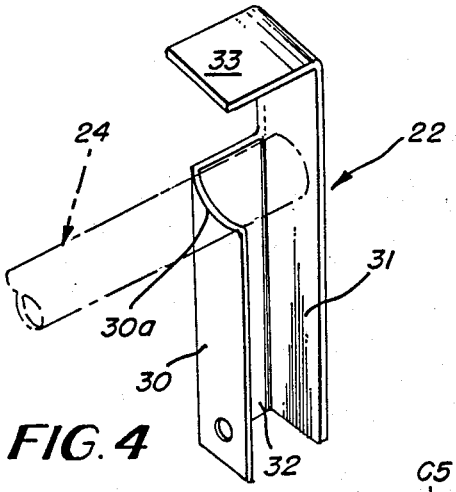
FIG. 4 is an enlarged perspective view of a support bracket formed according to a feature of this invention.

As is best shown in FIG. 4, bracket 22 includes an inner panel 30 and an outer panel 31. Panels 30 and 31 are interconnected by a panel 32 so as to form a structure of channel shaped cross sectional configuration. Inner panel 30 includes an arcuate upper edge portion 30*a* while outer panel 31 includes an inwardly extending tab 33 which is downwardly and forwardly inclined and parallel to the angle of inclination of an associated shelf such as 20. As is best shown in FIG. 3, tab 33 overlies the shelf 20. As is apparent from FIGS. 4 and 5, elongated element 24 is disposed immediately underneath shelf 20 so that the shelf is effectively captured against up and down movement by the elongated element 24 and the tab 33. As is apparent particularly from FIG. 4, elongated element 24 is arranged so that its right hand end as viewed in FIG. 4 is in closely spaced relation or in contact with the inner surface of outer panel 31 so that elongated rod 24 is secured against movement in one direction toward the right as viewed in FIG. 4.

Support bracket 23 is a mirror image of support bracket 22. Thus the inner panel 34 of support bracket 23 corresponds to and functions generally according to inner panel 30 of support bracket 22. Outer panel 35 of support bracket 23 corresponds to outer panel 31 of support bracket 30 so that elongated rod 24 is prevented from moving in one direction due to engagement of its end with the inner surface of outer panel 35. Tab 36 of bracket 23 corresponds to tab 33 of bracket 22. This tab overlies an edge of shelf 20.

Figure 7:
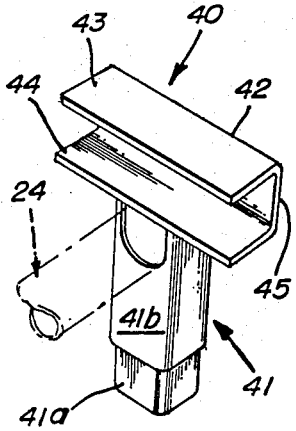
FIG. 7 is a perspective view of a different type of support bracket from that depicted in FIG. 4.

FIG. 7 shows a support bracket which functions in a manner very similar to the functioning of brackets 22. The support bracket generally designated by the numeral 40 includes a square body portion 41 which comprises a smaller lower part 41*a* and a larger upper part 41*b*. The upper part of panel 41*b* is configured in a manner somewhat similar to the upper edge 30*a* of support bracket 22. Disposed atop the square body portion 41 of support bracket 40 is a channel 42 having an upper panel 43 and a lower panel 44 which are interconnected by the vertical panel 45. An edge of a shelf such as 20 is interposed between panels 43 and 44 and is thus captured against up and down movement and against movement generally toward the right by panel 45 as viewed in FIG. 7.

For most applications of the invention, the support bracket such as is shown in FIG. 4 and its mirror image are preferred over that shown in FIG. 7 and its mirror image because of the simplicity of the structure identified as support bracket 22.

In order to convert a display stand having removable horizontal shelves such as 17–21 to a gravity feed device, it is simply necessary first to remove a shelf such as 20 and thereafter to mount the support brackets 22 and 23 in their associated cavities near the rear ends of their associated side rails. The elongated element 24 is then mounted in position as shown in FIGS. 2, 4 and 5. The removable front bumper rail 25 is then mounted as shown in FIG. 2. Thereafter the removable shelf such as 20 is mounted so that its front edge overlies the rearward extending portions 26*a* of front bumper rail 25 and with its rear portion overlying elongated element 24 and with its outer edges disposed underneath the tabs 33 and 36.

Figure 6:
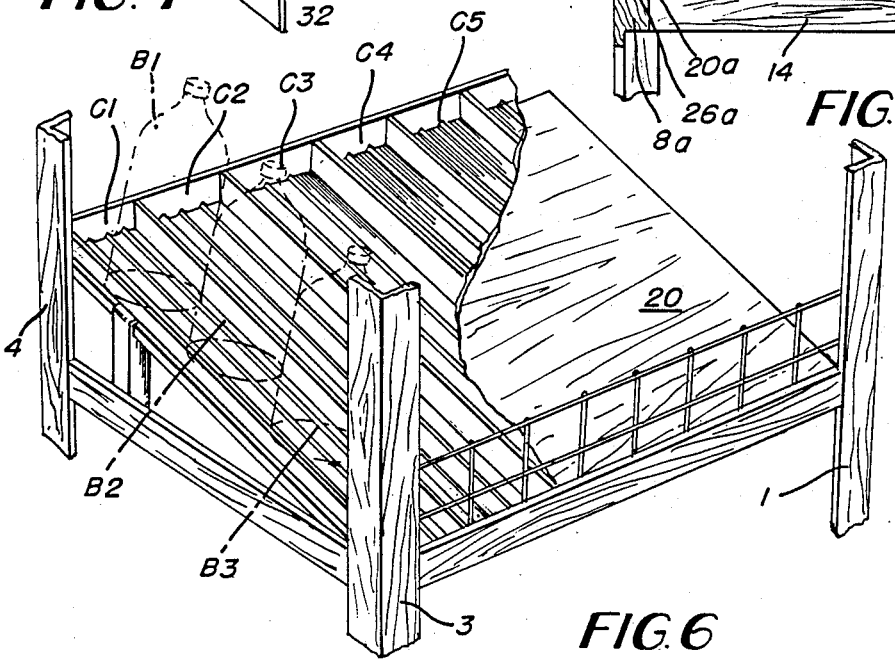
FIG. 6 is a view similar to FIG. 3 but which is taken from a somewhat different vantage point and which in addition to the structure of FIG. 3 shows low friction channel elements mounted top the shelf.

In order to facilitate sliding movement downwardly and toward the front of the articles such as are designated in phantom lines by the numerals B1, B2 and B3, a plurality of channel like low friction elements may be disposed atop the removable shelf 20 as shown in FIG. 6, the channel like low friction elements being designated C1–C5 inclusive. If desired, channel elements C1–C5 may be constructed as shown in FIGS. 1 and 2 of the aforementioned U.S. Pat. No. 4,565,725.

By the invention, it is apparent that conventional display devices having removable horizontal shelves may be easily, quickly and economically converted to gravity feed devices in accordance with this invention.

I claim:

1. A display stand having four corner posts, horizontal front, rear and a pair of side support rails disposed in a common plane and interconnected at their ends to said corner posts and forming a pattern of quadrilateral configuration having right angle corners, a complementary shelf of quadrilateral configuration having right angle corners removably supported by said front and side support rails, wherein the improvement comprises a pair of support brackets mounted on said side support rails respectively and adjacent the rear ends thereof and projecting upwardly therefrom, and an elongated support element arranged to extend between said support brackets and whose ends are removably mounted respectively on said support brackets at a level above said rear support rail so that the rear edge of said shelf is disposed above the level of said rear support rail when mounted with its rear portion disposed atop said elongated support element and arranged with its front edge in engagement with and supported by said front rail.

2. A display stand according to claim 1 wherein each of said side support rails includes a cavity adjacent to but spaced from its rear end which forms a seat into which the lower portion of one of said support brackets is removably mounted.

3. A display stand according to claim 1 wherein each of said support brackets comprises an inner panel which is arranged to removably engage and support said elongated support element adjacent one end thereof.

4. A display stand according to claim 1 wherein each of said support brackets comprises an outer panel which is disposed adjacent one end of said elongated support element so as to prevent substantial axial movement of said elongated support element in one direction.

5. A display stand according to claim 4 wherein an inwardly extending tab is formed on the upper end of each of said outer panels and arranged to overlie the adjacent side edge of said shelf.

6. A display stand according to claim 5 wherein each of said tabs is downwardly and forwardly inclined and in generally parallel relation to the angle of inclination of said shelf.

7. A display stand according to claim 1 wherein the lower portion of each of said support brackets is of channel shaped configuration.

8. A display stand according to claim 1 wherein the lower portion of each of said support brackets is of generally square cross sectional configuration and wherein a channel is disposed atop said lower portion and downwardly and forwardly inclined at the angle of inclination of said shelf for receiving the adjacent side edge portion of said shelf.

9. A display stand according to claim 8 wherein the lowest part of said lower portion of each of said support brackets is somewhat smaller than the uppermost part of said lower portion of each of said support brackets.

10. A display stand according to claim 1 wherein a removable front bumper rail includes an upper upstanding part for arresting forward movement of articles disposed on said shelf and an integral rearwardly extending lower part arranged for disposition between said front rail and the front edge of said shelf.

11. A display stand according to claim 10 wherein the ends of said upper upstanding part of said removable front bumper rail are arranged in contact with the adjacent front corner post respectively.

12. A display stand according to claim 1 wherein low friction means is disposed atop said shelf.

13. A display stand according to claim 1 wherein said elongated support element comprises a rod of circular cross-section.

* * * * *